United States Patent [19]

Weber et al.

[11] 4,221,641

[45] Sep. 9, 1980

Best Available Copy

[54] METHOD OF CHANGING ELECTRODES IN A REDUCTION CELL

[75] Inventors: Rudolf Weber, Männedorf, Switzerland; Hans Schaper, Rheinfelden, Fed. Rep. of Germany

[73] Assignee: Swiss Aluminium Ltd., Chippis, Switzerland

[21] Appl. No.: 25,380

[22] Filed: Mar. 30, 1979

[30] Foreign Application Priority Data

Apr. 3, 1978 [CH] Switzerland ..... 3527/78

[51] Int. Cl.[3] ..... C25C 3/20; C25C 7/06

[52] U.S. Cl. ..... 204/67; 204/64 R; 204/225

[58] Field of Search ..... 204/67, 64, 225

[56] References Cited

U.S. PATENT DOCUMENTS 3,480,526 11/1969 Duclaux ..... 204/67

*Primary Examiner*—Howard S. Williams

*Attorney, Agent, or Firm*—Bachman and LaPointe

[57] ABSTRACT

Anodes are releasably attached to an anode beam. If an anode is burnt-away so far that it must be exchanged, then it is exchanged with the help of a crane. The burnt-away anode is pulled out until, after passing through a certain travel the surface facing the cathode has reached a predetermined horizontal plane. The distance travelled through until then is stored. The new anode is positioned with the surface facing the cathode in a second horizontal plane and is lowered towards the cathode in accordance with measurement of the stored travel the distance between the two horizontal planes and possibly with regard to different saggings of the crane caused by the different weights of the new and the old anode.

24 Claims, 9 Drawing Figures

METHOD OF CHANGING ELECTRODES IN A REDUCTION CELL

BACKGROUND OF THE INVENTION

The present invention relates to a method for measuring electrodes to be exchanged in electrolysis cells, after using up of the electrode surface directed towards the opposed electrode, in which one withdraws from the cell the electrode to be exchanged, and lowers in a new one in its place.

In a known manner, in the electrolysis of aluminium carbon anodes are employed, which in the course of their period of operation burn away more and more. In this connection, firstly the anodes must be continuously newly positioned during their period of use after measurement of the burning away, because it is of the greatest importance that their adjustment of spacing with reference to the aluminium cathode satisfies predetermined criteria. More simply stated, the surfaces of the anodes facing the cathode must be always held at constant spacing with reference to the aluminium cathode. As soon as an anode is completely burnt away, it must be exchanged, while the newly inserted anode must be positioned with reference to the aluminium cathode in the same position as the exchanged one. For this purpose it is usual to provide the old anode with a chalk mark, to place the old and the new anode alongside one another on the floor, and to transfer the measurement marked with the chalk mark on the old anode onto the new one. This procedure is however liable to error, caused by the width of the chalk mark, errors of parallax during the transference of the measurement from the old anode to the new anode, irregularities of the surface on which hey are stood etc. Fundamentally the described customary method strongly depends as regards its precision on subjective measurement errors of the operating personnel as well as on accidental objective errors.

SUMMARY OF THE INVENTION

In order to avoid the above-mentioned disadvantages, by the present invention a method is proposed, which comprises the steps of withdrawing an old electrode to be exchanged, recording the transit of a first plane by the old electrode surface directed towards the opposed electrode, storing the withdrawal distance travelled through by the old electrode up to this transit, lowering a new electrode, detecting the transit of a second plane parallel to the first plane by a new electrode surface directed towards the opposed electrode, the spacing of the two planes being known, further lowering the new electrode starting from the transit of the second plane, through a travel towards the cell which is equal to the stored withdrawal travel, connected by the spacing of the two planes.

An arrangement for carrying out the method of the present invention comprises a withdrawal/introduction device for electrodes, first detection means for measuring the electrode displacement travel, and further detection means for detecting the transit of first and second planes by a surface directed towards an opposed electrode of the old electrode or the new electrode. A detector, for checking the attainment of a predetermined position by an electrode in the aforenoted arrangements comprises a lever, which can pivot about an axis and which at least in working position extends into a zone passed through during the removal of an old electrode or introduction of a new electrode, and detector means adapted to detect the movement of the lever, the detector means including a light beam constituted by a stationarily arranged receiver/transmitter arrangement and a mask on the lever for interruption or transmission of the light beam.

Since the total length of the old used-up electrode is unknown, it must be detected outside the elctrode operating position. For this purpose, the attainment of a predetermined position by electrodes for electrolysis during their exchange must be exactly established. For this purpose a detector is proposed, which includes a first angle piece arranged on the lever, on which acts the spring means, and wherein the line of action of the spring force relative to the axis is displaced laterally in the working position of the lever, and upon attainment of the predetermined angle by the lever the side changes with reference to this axis, so as to then swing the lever into rest position.

BRIEF DESCRIPTION OF THE DRAWINGS

The invention will be explained hereafter by way of example with reference to drawings wherein.

DETAILED DESCRIPTION

Figure 1:
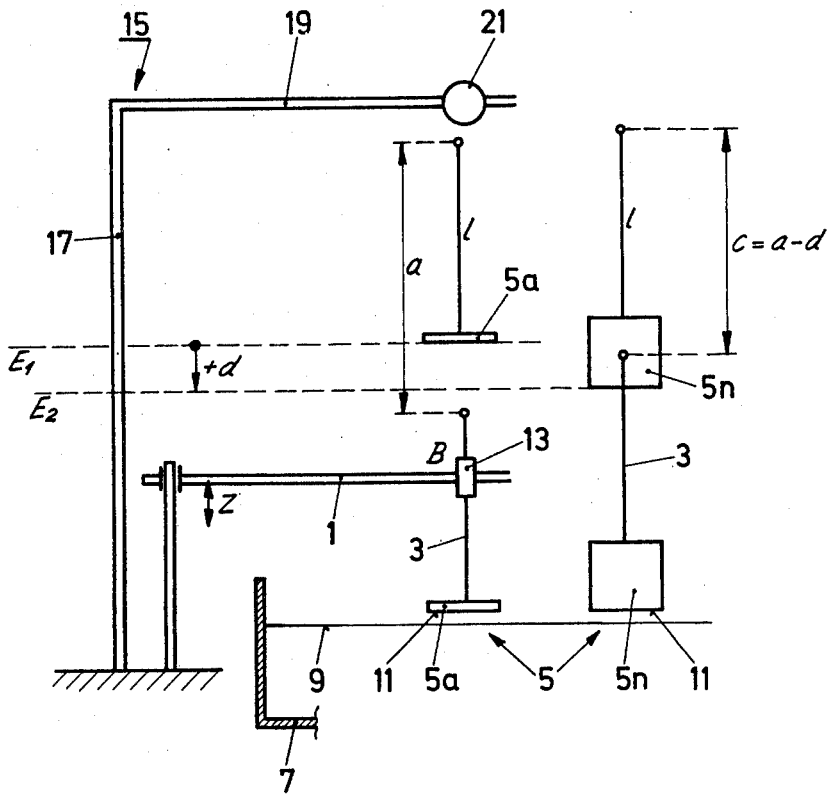
FIG. 1 is a diagrammatic view of the gripping and removing devices for the anodes in an electrolytic cell, for explanation of significant dimensional magnitudes and their relationships for the accurate exchange of an old anode by a new one.

In FIG. 1 there is shown schematically an anode beam 1, on which are releasably attached suspension rods 3 for anodes 5. The anodes 5 hang from gripping devices 13, with the help of which they can be adjusted relatively to the beam 1. This possibility of adjustment is provided, as is known, in order to be able to individually lower and raise the anodes according to measurement of experimental values, e.g. of current density and cathode curvature. The anode beam itself is adjustable in height as a totality, as is indicated by the arrow z, in order to be able to lower all the anodes together according to measurement of the average burning up. The anodes 5 extend into the electrolysis cell 7 indicated diagrammatically.

If now an anode is burnt up so far that it must be exchanged, then it is pulled out from the electrolysis cell 7 after release from the holding device 13, with the help of a crane 15 also shown schematically in FIG. 1, with vertical supports 17 and horizontal supports 19 as well as a lifting device 21. In FIG. 1 a burnt-up anode is indicated at 5*a*. With the help of the crane 15 it is then pulled up so far out of the neighbourhood of the cell 7 and of the anode beam 1, until its burnt-up surface 11 is in the neighbourhood of a first horizontal plane $E_1$.

The burnt-up surface is in practice never a flat plane, but in the majority of cases it is burnt-up further in its peripheral zones than in the middle. In consequence it is for example specified that the anode surface 11 has reached a horizontal plane when the plane horizontally tangent to it lies in the said horizontal plane.

The lifting travel a, which is to be travelled by the surface 11 of the anode up to attainment of the plane $E_1$, is stored. Thereafter the old anode is transported by the crane 15 to an anode store (not shown) and there a new anode 5*n* is picked up. The new, substantially higher anode 5*n*, which has an unaltered length l of its anode rod 3, is positioned with the help of the crane 15 with its not yet burnt-up surface 11 in a second horizontal plane $E_2$.

With knowledge of the distance d from the first to the second plane $E_1$, $E_2$ and the travel a for the old anode 5*a*, the new anode 5*n*, starting from the plane $E_2$, is lowered through an amount c, which is determined by the expression $$c=a-d$$

After the lowering of the new anode 5*n* through the travel c, the anode surface 11 of the new anode lies with reference to the aluminium cathode 9 in exactly the same position as the surface 11 of the old anode 5*a* was positioned before its removal.

Figure 2:
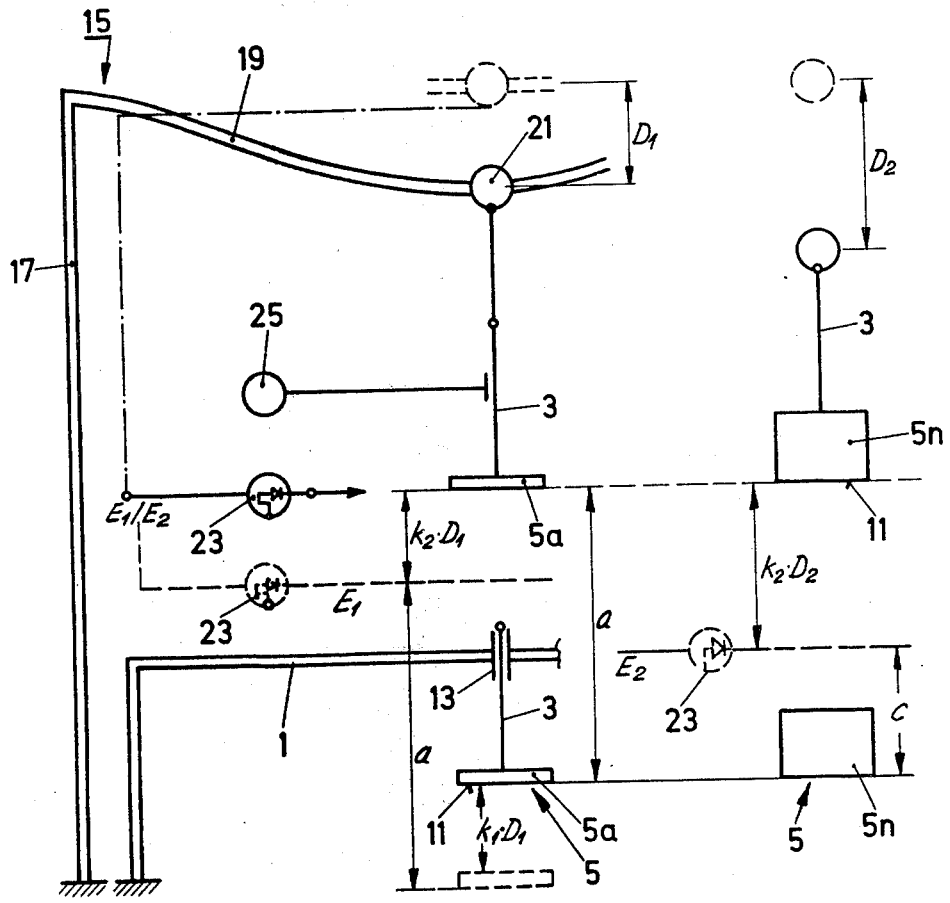
FIG. 2 is a view analogous to FIG. 1, having regard to different loading conditions of the removal device, caused by different weights of the old and new anode.

FIG. 2 shows a view analogous to FIG. 1, for explanation of the influences of the varying loadings on the crane. During the removal of the old anode 5*a*, the latter descends, e.g. through $k_1D_1$ corresponding to a sag $D_1$ of the horizontal support 19. According to the constructional arrangement of the plane $E_1$, this descends through $k_2D_1$, by reason of the loading of the crane. If the plane $E_1$, with a passing detector 23 arranged in it, is coupled structurally with the lifting point, for example the lifting device 21 of the crane 15, as this is indicated in broken lines in FIG. 2, then it descends, as this is indicated in broken lines, likewise through $D_1$, $k_2$ becomes 1.

If, before one releases the anode from the anode beam 1, the weight of the anode is first taken up by the crane, then $k_1$ becomes 0. Then the sag $D_1$ does not transmit itself to the anode.

Upon taking up the new, significantly heavier anode 5*n*, a greater loading of the crane results, so that the second horizontal plane $E_2$, with a through passage detector 23 arranged in it, descends through $K_2D_2$, corresponding to the descent $D_2$ of the lifting device 21.

If the lifting travel of the old anode 5*a* as far as reaching the plane $E_1$ is again indicated as a, and the lowering travel for the new anode 5*n* again with c, then there results $$c=a+D_1(k_2-k_1)-k_2D_2$$

So long as in the unloaded condition the position of $E_1$ is the same as that of $E_2$, which is indicated in FIG. 2 by $E_1/E_2$.

From the combination of the showings of FIG. 1 and FIG. 2 is then results that the lowering travel for the new anode 5*n* in the general case is given by the expression $$c=a-d+K_2(D_1-D_2)-k_1D_1$$

where the indications are:

d the distance of the plane $E_1$ from $E_2$, in the unloaded condition, $D_1$ the sag of the lifting device 21 upon loading with the old anode, $D_2$ the sag of the lifting device 21 upon loading with the new anode, $k_1$ is proportionality factor between sag $D_1$ of the lifting device and descent of the old anode 5*a*, where $k_1=0$ is true with taking up of the anode weight previous to release of the anode, and otherwise $k_1=1$ is true.

$k_2$ a proportionality factor between sag $D_1$,$D_2$ of the lifting device and descent of the planes $E_1$,$E_2$ with $$0 \leqq k_2 \leqq 1$$

A first constructional and valuable simplification results if both the horizontal planes $E_1$ and $E_2$, as shown in FIG. 2, are defined as the same plane $E_1/E_2$. According to the showing in FIG. 2, then only the different loadings have to be regarded, d is zero.

Only a single passage detector 23 is provided, for the detection of the passing of the surface 11 of the old and also of the new anode.

Naturally it is possible, without more ado, from knowledge of the different anode weights on the one hand, in the burnt-up and new condition and also the mechanical data of the crane on the otherhand, to have regard to the different loadings on the crane by pure calculation, while correspondingly correcting the stored travel distance a. Since in any event for the exact individual and total positioning of the anode relative to the cathode computers are frequently employed, no special additional expenditure results from this procedure. Data of the crane, anodes, new weight and the weight of the burnt-up anodes as an average experimental value, can simply be stored and calculated into correcting terms. Although a relatively exact positioning of the new anode 5*n* is thus possible, this calculating method has however the disadvantage, that the weight of the old burnt-up anode 5*a* must be entered into the calculation as an experimental value, and differences from one burnt-up anode to another cannot be regarded.

Figure 3:
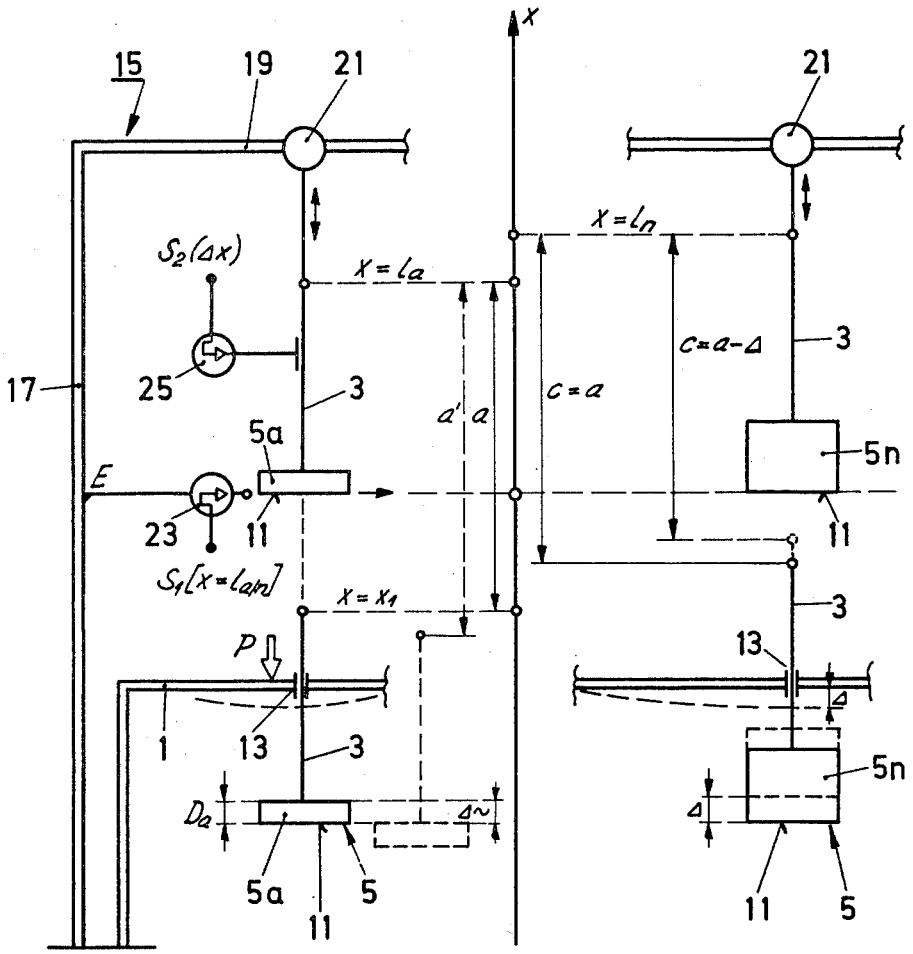
FIG. 3 is a further view analogous to FIGS. 1 and 2, additionally having regard to different loading of the anode grip, caused by the different weights of the old and new anode.

In this connection an improvement of exactness is achieved in that the passage detector 23 and correspondingly the plane $E_1/E_2$, hereafter called E, is arranged constructionally so that different crane loadings do not displace it. Then $k_2$ becomes 0. As is shown in FIG. 3, for this purpose the passage detector 23 is for example connected with the vertical supports 17 of the crane 15. Then by the construction, for example of the vertical supports, it must be ensured that displacements of the plane E during different crane loadings become negligible.

In FIG. 3 there is marked a coordinate axis x parallel to the direction of lifting, the zero point of which should be established at the level of the detector 23, that is in E. x should be e.g. the position coordinate of the point of suspension of the anode rod 3 on the crane 15. With the holding device 13 unloaded, yet the old anode 5*a* not yet lifted, its position is $x_1$. The travel detector 25 detects the lifting travel passed through by the old anode 5*a*, until its surface 11 reaches the plane E observed by the detector 23. Then the detector 23 gives a signal $S_1(x=l_a)$, where $l_a$ corresponds to the total length of the old anode. Corresponding to an output signal $S_2(l_a-x_1)$ from the detector 25, the lifting travel a, as yet to be described, is stored at this moment. The output signal of the detector 25 is indicated in general in FIG. 3 as $S_2(\Delta x)$. After the storage of the lifting travel a, the old anode 5*a* is removed to the anode store as has already been mentioned, the new anode 5*n* is gripped and positioned with its surface 11 in the plane E observed by the detector 3. Then the detector 23 gives a signal $S_1(x=l_n)$, which indicates that the point of the connection of the crane and the anode rod 3 lies exactly by the new total anode length $l_n$ above the plane E. Thereafter the new anode 5*n* is lowered through the recorded lifting travel a. Then the surface 11 of the new anode 5*n* lies in the desired position.

In the explanations hitherto, the sag of the anode beam 1 has remained disregarded. By the introduction of the new, substantially heavier anode, it becomes loaded to a greater extent, so that a greater sagging occurs, according to the point of attachment of the exchanged anode. Although this additional sagging in most cases can be ignored, it is possible without more ado to compensate also for this exactly. This compensation must take place after measurement of the difference of weight between new and old anode. Since, however, the weight of the old anode must first be produced by additional devices, it is proposed that the weight of the old anode should be first taken up by the crane, i.e. the holding device 13 is first unloaded and then the anode beam 1, as indicated with the arrow P in FIG. 3, is loaded with a force corresponding to the known weight of the new anode. Hence the anode beam 1 sags in exactly the way in which it will sag later until taking up of the new anode 5*n*, and the old anode 5*a* then descends (shown in broken lines). The descent Δ is measured, for example with the detector 25, and likewise stored, so that the lifting travel a' thereupon attained can be corrected by the amount 2Δ and the downward travel c for the new anode 5*n* is given as $$c=a'-2\Delta=(a+\Delta)-2\Delta=a-\Delta$$

By this method the difference in weight between new and old anode need not be provided.

The method described, with the measuring device shown especially with reference to FIG. 3, is suitable particularly for an automation of the anode measuring. Of course this method can however be carried out without any automation, while the output signal of the detector 23 is noted by an operator, who on lifting out of the old anode 5*a* then for example quickly stops the crane, reads off the output signal of the travel detector 25, and then manually controls the corresponding downward travel for the new anode 5*n*. If correction terms are to be regarded, then the operator takes account of them.

Of course, the method described is suitable not only for the positioning of exchangeable anodes in an electrolysis cell for aluminium, but generally for the exchange of electrodes in electrolysis processes, in which the electrode surface facing the opposite electrode is used up and an exact positioning of electrode and of opposed electrode is necessary.

Figure 4:
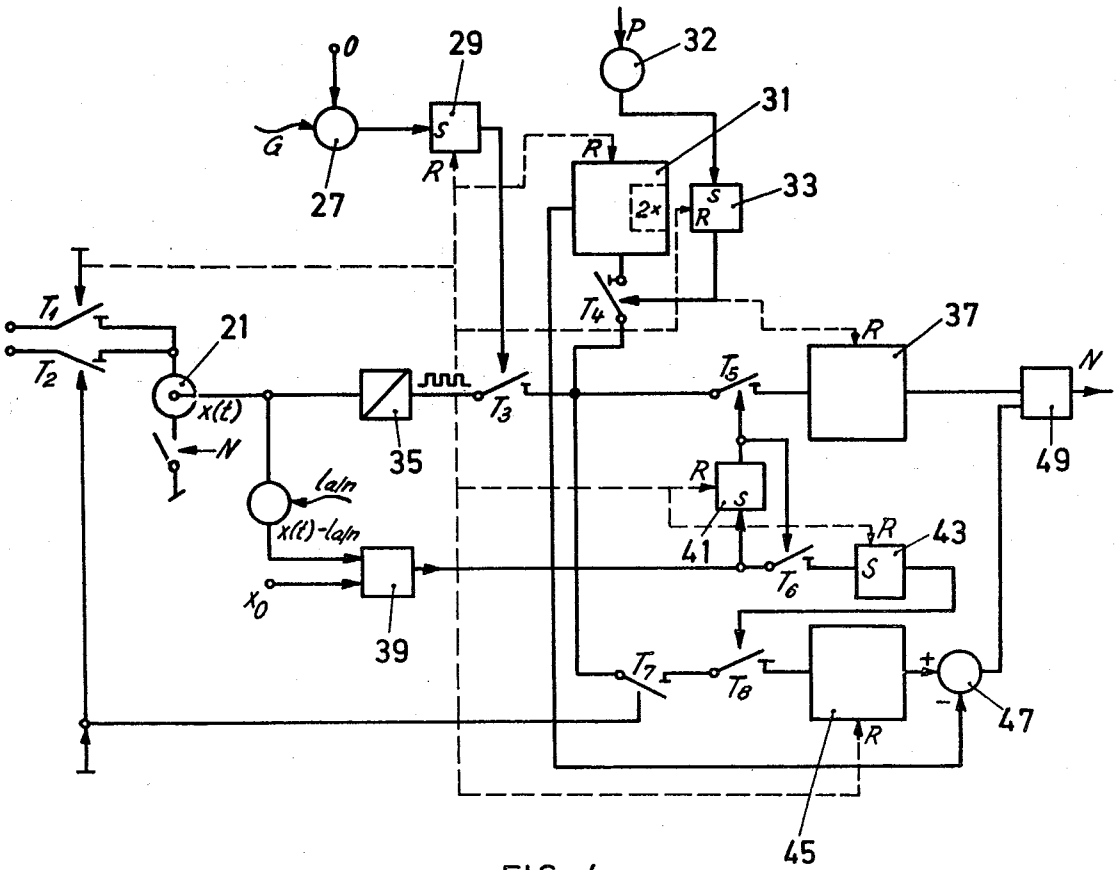
FIG. 4 is an operational block diagram of an arrangement for carrying out the method explained with reference to FIGS. 1 to 3.

In FIG. 4 is shown an operational block diagram for the automation of the method described. For the lifting out of the old anode 5*a*, a lifting switch $T_1$ for the lifting device 21 is actuated by hand. In consequence in the first place bistable elements 29, 33, 41 and 43 as well as a store element 31 and a detecting device 45 are reset. The movement of the lifting device 21 causes an alteration of the coordinate position of the point of connection of the anode rod 3 and the crane grip, corresponding to the travel x(t). The travel x(t) is converted in a converter 35, corresponding to the detector 25 of FIG. 3, into a physical quantity which can be further evaluated, and in particular stored. For example the converter 35 produces at its output electrical impulses corresponding to successive increments of travel. At this moment the old anode 5*a* is still held in the holding device 13. Consequently the lifting by the crane causes an unloading of the holding device 13, which is detected by the schematically indicated load detector 27 on the holding device. It compares the loading G of the holding device 13 with the zero loading. When a total unloading has been attained, then a bistable element 29 is actuated, so that an unloading switch $T_3$, which is connected into the output from the converter, is closed. At this moment the lifting device 21 is preferably temporarily stopped (control not shown). Now the anode beam 1 is loaded with a simulated load according to FIG. 3, by which the old anode 5*a* is depressed, corresponding to the sag of the anode beam 1. The travel caused in this way is led through a switch $T_4$ which is then closed to a storage element 31, until the simulated load attains its desired value P, whereupon the switch $T_4$ is opened by a bistable element 33, and a travel corresponding to 2Δ from FIG. 3 is stored in the storage element 31. A loading detector is shown schematically at 32, which is arranged for example on the anode beam.

The output of the converter 35 is connected through the unloading switch $T_3$ which is still closed and a closed switch $T_5$ with a storage element 37, which is reset at the moment of the opening of the switch $T_4$. Now the grip between the holding device 13 and the old anode 5*a* is released and the lifting device 21 is again activated, by which means the old anode 5*a* is pulled out of the holding device 13. The simulated load P can now be removed. The lifting stroke travelled is conveyed to the storage element 37, converted by the converter 35.

The displacement x(t) of the connection point of anode rod 3 and lifting device of the crane performs a corresponding raising of the anode surface 11, which travels through coordinate values corresponding to $x(t)-l_a$. This position of the anode surface 11 is compared in a comparison unit 39 with a predetermined fixed value $x_0$. Upon agreement, the comparison unit 39 gives out an agreement signal, by which a bistable element 41 is changed. By this the switch $T_5$ is opened, and the connection between the converter 35 and the storage element 37 is interrupted. Thus the lifting stroke travelled up until then corresponding to a or a' of FIG. 3 is stored in the element 37. With the opening of the switch $T_5$, a switch $T_6$ is closed, which connects the output of the comparison unit 39 with a further bistable element 43.

Now the old anode is deposited in the anode store, the new anode picked up and lowered through the opening of the cell. This lowering is started by the manual actuation of a lowering switch $T_2$. The closing of the lowering switch $T_2$ causes the closing of a switch $T_7$, which is connected to the output of the converter 35 through the unloading switch $T_3$. The surface 11 of the new anode 5*n* during descent passes through coordinate values corresponding to $x(t)-l_n$. If this position agrees with the predetermined value $x_0$, then the comparison unit 39 again gives out an agreement signal, which is carried through the switch $T_6$ which is then closed, to the bistable element 43, which closes a switch $T_8$.

The output of the converter 35 is then connected through the closed switches $T_3$, $T_7$, $T_8$ with a recording unit 45. From its output comes a signal corresponding to the descending distance travelled, which is corrected in a subtraction unit 47 by the correction value $2\Delta$ stored in the storage element 31. The corrected descent travel is compared in a comparison unit 49 with the lifting travel stored in the storage element 37. Upon agreement of the compared signals, the comparison unit 49 gives an output signal N, by which the lifting device 21 is stopped. The new anode 5*n* has then reached its desired position in the cell.

If the converter 35, as for example has been mentioned, produces electrical impulses as a function of travel increments passed through, then the storage elements 31, 37 and the recording unit 45 are preferably constituted as counters. By interruption of the supply lines for the converter output pulses to the elements 31, 37, the counters are stopped and operate from that moment onwards as stores. A counter acting as a recording unit 45 counts the increments of travel passed through during the descent of the new anode.

If the storage element 37 is constituted as a forward and backward counter, then the recording unit 45 can be omitted, because during lowering of the new electrode the forward and backward counter can be switched in in backward counting operation, and counts backwards towards zero from the final value reached after the lifting of the old anode. The correction value $2\Delta$ is then taken account of in that the backward counting during lowering of the new anode 5*n* takes place not to zero, but to a corrected value, at the attainment of which the lifting device 21 is stopped.

It is self-evident that the operating units indicated in FIG. 4, such as switches, bistable elements etc. can preferably be constituted as electronic components, the switching functions as signal connections by means of logical gates. Fundamentally there need to be stored only the lifting travel of the old anode up to a predetermined position, as well as possible correction values. Then, starting from the same position, the lowering travel of the new anode is compared with the stored lifting travel, if necessary after undertaking a correction.

The connection of the unloading control for the holding device 13 with the recording of the lifting travel as well as the application of the simulated load P can of course be omitted if lesser requirements for precision are furnished.

The comparison device 39 corresponds to the detector 23 of FIG. 3. The converter 35 can also be formed to give an absolute measurement for the lifting stroke travelled, and for that purpose can itself for example include a counter. Then only fixed quantities need be stored in the storage elements 31 and 37, corresponding to the converter counter conditions which have occurred at the times of opening of the switches $T_4$ and $T_5$ respectively. The counter output signal is, during lowering of the new anode, compared directly with the value stored in the store 37, if necessary after previous correction by the correction value stored in the store 31.

Since in any event for the continuous control/regulation of the anode position in electrolysis cells for aluminium a computer arrangement is often provided, the arrangement described with reference to FIG. 4 for automation of the anode measurement can be integrated without more ado in the computer already provided.

Figure 5:
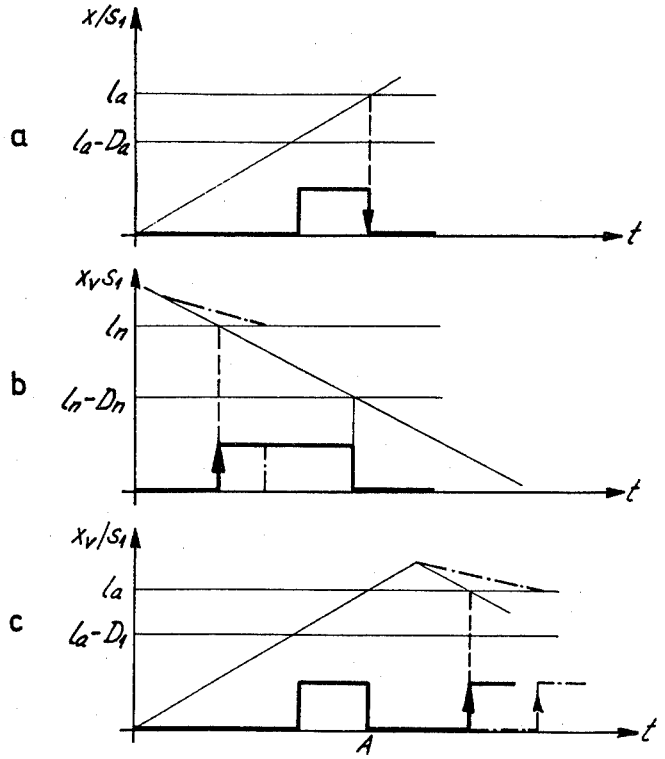
FIGS. 5*a* to 5*c* is a comparison of the output signals emerging from a position detector in devices according to FIG. 3, as a function of time and of the displacement travel of the anodes.

A disadvantage of the measuring method described up till now consists in the fact that two different dynamic switching criteria are evaluated by the detector 23 for the detection of the position of the old and new anode. If the detector 23 switches its output signal, for example high, as soon as the anode as a whole passes through the observed plane E, then, in dependence on the time, during lifting of the old anode 5*a* there results an output signal according to FIG. 5*a*. When the travel x has reached the value corresponding to $(l_a-D_a)$ (compare FIG. 3) then the detector records the beginning of the passage of the old anode 5*a* through the plane E. $D_a$ then corresponds to the anode thickness. If the travel x has reached the value $l_a$, then the old anode leaves the observed plane E and the detector output signal falls, as is indicated in FIG. 5*a* by the descending limb provided with an arrow. This switching limb is taken as the positioning criterion. Upon introduction of the new anode 5*n* into the observed plane E, the output signal of the detector 23 rises according to FIG. 5*b*, as soon as the travel x has reached the value $l_n$, with a positive switching limb, which then is used directly as the position criterion.

As is known, switching elements, especially electrical ones, frequently have ascending and descending switching limbs of different steepness. In order to avoid from the beginning such influences on the precision of positioning, either the old or the new anode is first moved out above its desired position, and then after a reversal of the direction of travel is brought to its desired position in the same direction as the other anode. This is indicated in FIG. 5*c* for the old anode. It is first withdrawn completely through the observed plane E, until the travel x is greater than $l_a$, whereupon the direction of travel is reversed, and it is again introduced from above into the observed plane E. In this case for both anodes there is an ascending switching limb available as the criterion for positioning (combination FIG. 5*b*, 5*c*).

As shown in FIGS. 5*b* and 5*c* in broken lines, it is generally advantageous, shortly before attainment of the desired position of both anodes, to reduce the speed of travel and to bring the anode surface 11 to the desired position with a smaller speed of approach.

The approaching movement of the anodes to the observed plane E, as explained, with the corresponding reversal of direction of travel, can of course be automatically controlled by the evaluation of the output signal from the detector 23.

Figure 6:
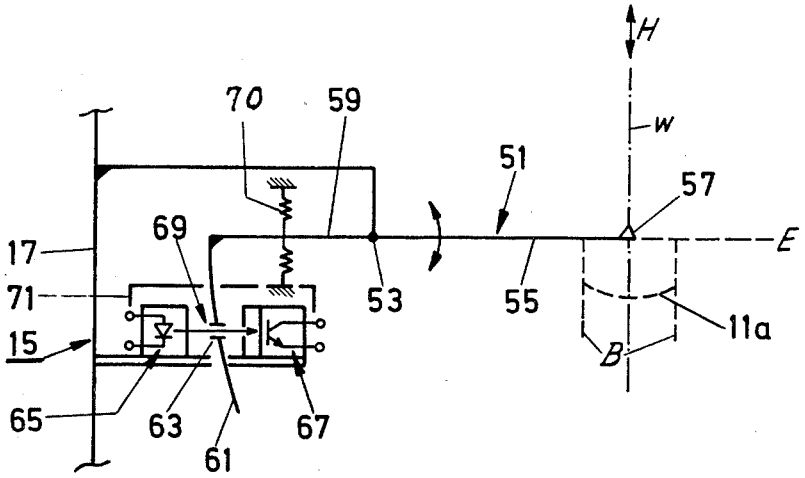
FIG. 6 is a schematic view of a position detector for the detection of a predetermined position of the burnt-up anode surface.

The detector 23 according to FIG. 3, corresponding to the comparison unit 39 of FIG. 4, can be constituted as an optical-electrical converter, in that a light beam is provided in the plane E to be detected, the interruption of which by the anodes is recorded by the converter. Since, however, in the immediate neighbourhood of the cell there exists a severe dirtying of the atmospheric air, a clear detection of the anode position without additional expensive precautions is doubtful with light beams. Such additional precautions can consist on the one hand in the provision of extremely condensed light beams, for example of laser beams, of through the preparation of detection criteria according to which for example the light beam is observed during a predetermined time and only then with certainty a signal is taken off as to whether the anode truly has attained the desired position or not. In FIG. 6 is shown an extremely simple mechanical/optical-electrical feeler as detector 23, which combines best the safety againt failure of a mechanical detector with the advantages of an optical-electrical observation of position. For example on the vertical support 17 of the crane 15 there is journalled a lever 51 on a pivot 53 in such a way that it can swing in a plane parallel to the direction of travel H of the crane. One arm 55 of the lever 51 extends with a detecting head 57 into the zone B travelled through by the anodes during their removal or lowering. As has already been mentioned, the anode surface 11 of the old anode at its edge zone is frequently more strongly burnt away than in its centre, so that, as is indicated with the surface $11_a$ in FIG. 6, it is curved convex away from its centre. In consequence, the detector head 57 of the arm 55 preferably extends to the operating centre line w of the crane travel H. On a lever arm 59 arranged opposite the arm 55 in relation to the bearing 53 there is arranged a mask 61 with an aperture 63, which moves up and down with the lever 51. An optical transmitter 65 with a receiver 67 formed as an optical-electrical converter is provided; this is stationary, preferably again arranged on the vertical support 17. With the transmitter 65 and the receiver 67, there is constituted an observed light beam 69, which is opened and interrupted respectively by the aperture 63 in the mask 61. The lever 51 is held in neutral position, for example by spring elements 70, so that it can be displaced by both directions of movement of the anodes, and mechanical damage by the anodes is excluded. It is however also possible to hold the lever 51 in downward swung position, until the old anode has passed through the plane E from below upwards, and then to permit it to swing upwards. This swinging upwards can for example by released by the switching limb A according to FIG. 5*c*.

Of course it is without more ado possible to arrange the mask 61 with the aperture 63 stationary, and to couple either the receiver 67 or the transmitter 65, or even both, to move with the lever arm 51. The embodiment shown in FIG. 6 has however the advantage that electrical connections need not be made to any movable parts. By the length ratio of the arms 55 and 59, influenced by the condensing of the beam ray and the width of the aperture 63, the movement of the lever 51 by the anodes can be most exactly detected. The optical-electrical arrangement with the light beam 69 is advantageously arranged outside the immediate neighbourhood of the cell, and, as is indicated by the screen 71, enclosed and thus protected from dirt and dust.

Figure 7:
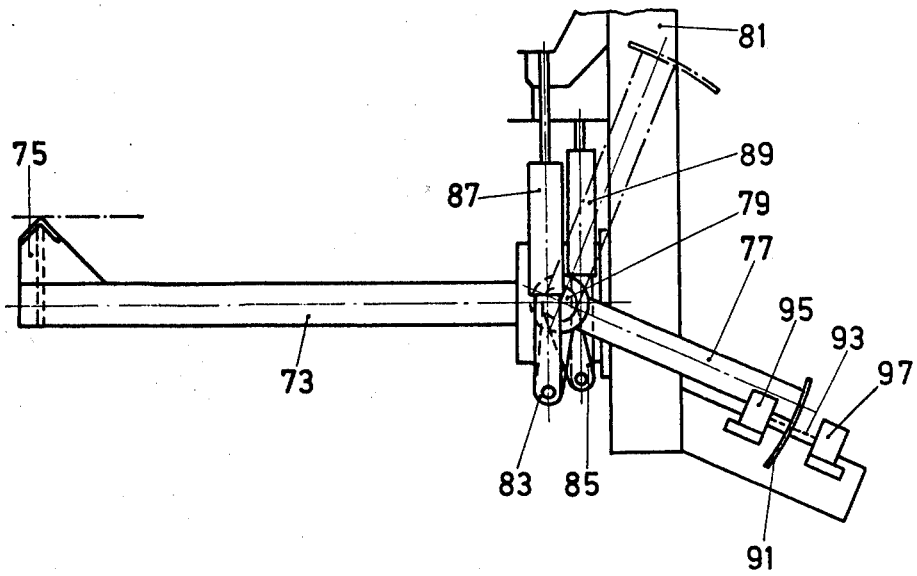
FIG. 7 is a side view of a possible embodiment of the detector shown schematically in FIG. 6.

In FIG. 7 is shown the embodiment of the mechanical/optical-electrical detector explained fundamentally with reference to FIG. 6. Since on the ground of costs, attempts must be made to keep the necessary magnitudes of travel as small as possible, it is proposed to hold the lever swung downwards in its rest condition and to swing it up for the first time when the anode has left the plane E by a minimum distance. A detector arm 73 with a detector head 75 is fixedly connected with a slightly bent transmission arm 77. The two together constitute a lever 73, 77. The lever 73, 77 is journalled on a pivot 79 to tilt relative to a support 81. Directly in the neighbourhood of the pivot 79 two angle pieces 83 and 85 are provided on the lever 73, 77. The one angle piece 83 is slightly bent with reference to the axis of the bearing 79 in clockwise direction, the angle piece 85 in the opposite rotary direction. On the angle piece 83 there acts a spring piston 87, while on the angle piece 85 there acts a preferably hydraulically actuatable piston 89.

The arm 77, slightly bent relative to the arm 73 as mentioned, carries at its end a mask 91 for cutting off and transmitting a light beam 93 in a photoelectric receiver/transmitter arrangement 95, 97. Like the pivot 79, the photoelectric receiver/transmitter arrangement 95, 97 is fixed stationarily on the carrier 81. The spring means 79 according to FIG. 6 are constituted by the spring piston 87. In the working position shown in FIG. 7, the angle piece 83 makes an acute angle with the axis of the spring piston 87, so that, if a predetermined load acts downwards on the arm 73, and the angle piece 83 makes an acute angle with the axis of the spring piston 87, the lever 73, 77 is snapped into the rest position in the anticlockwise direction under spring drive. The dead position is passed at the moment when the line of action of the force of the spring piston 87 changes sides relatively to the axis of the bearing 79, so that the moment exerted by the said spring piston on the lever 73, 77 changes its direction. By lowering of an anode through the plane E, the lever 73, 77 is thus snapped downwards in the anticlockwise direction. If the passing through of the plane E by an anode or of its surface facing the opposite electrode is again to be detected, then the piston 89 is actuated, for example by the switching limb A according to FIG. 5*b*, in such a way that, via the angle piece 85, it presses the lever 73, 77 back through the dead position into the working position according to FIG. 7 again. So that the downward snapping is not influenced by the piston 89, in the working position of the lever 73, 77 it is switched off and without pressure.

With the method described, exactnesses of positioning for carbon anodes of $\pm 1$ mm are attained. By the method and also the control arrangement an extremely exact exchange of anodes in aluminium electrolysis is thus made possible, while, especially if electronic control devices for the anode positioning are already present, only a small further expenditure is necessary for carrying out the methods. The detector proposed makes possible in a simple manner establishing the transit of a predetermined position by the anodes.

It is to be understood that the invention is not limited to the illustrations described and shown herein, which are deemed to be merely illustrative of the best modes of carrying out the invention, and which are susceptible of modification of form, size, arrangement of parts and details of operation.

We claim:

1. A method of measuring electrodes to be exchanged in electrolysis cells, after using up of an electrode surface directed towards an opposed electrode, comprising the steps of withdrawing an old electrode to be exchanged, recording the transit of a first plane above the cell by the old electrode surface directed towards the opposed electrode so as to measure the length of the old electrode, storing the withdrawal distance travelled through by the old electrode up to this transit, lowering a new electrode, detecting the transit of a second plane above the cell parallel to the first plane by a new electrode surface directed towards the opposed electrode so as to measure the length of the new electrode, measuring the spacing between the two planes further lowering the new electrode starting from the transit of the second plane, through a travel towards the cell which is equal to the stored withdrawal travel less the spacing of the two planes.

2. A method according to claim 1, including determining the further lowering travel for the new electrode after measurement of the difference of displacement of the planes dependent upon loading with different loading of a withdrawal/introduction device for electrodes by the old electrode and the new one, and also the measurement of descent of the electrode to be exchanged with corresponding loading of the withdrawal/introduction device.

3. A method according to claim 1, including, either during withdrawal of the old electrode, or during lowering of the new electrode, reversing the direction of travel of the electrode after transit of the first plane or the second plane respectively by the electrode surface directed towards the opposed electrode, and then detecting a further transit, in order to create the same dynamic detecting criteria for the transit both with the old electrode and with the new one.

4. A method according to claim 1, wherein the old electrodes to be exchanged are arranged in holding devices in the cell, which are loaded with the weight of the electrodes, including loading the holding device with a load corresponding to the new electrode before the start of a measurement of the withdrawal travel, to have regard to the later loading.

5. A method according to claim 4 including first unloading the holding device from the old electrode to be exchanged, and thereafter loading said loading device with a load equal to the weight of the new electrode, then releasing the fastening of the electrode to be exchanged and measuring the withdrawal travel from then on, and correcting the lowering travel for the new electrode by the sag of the holding device during the loading with the load equal to the new electrode.

6. An arrangement for carrying out the method according to claim 1, comprising a withdrawal/introduction device for electrodes having first detection means for measuring the electrode displacement travel and second detection means for detecting the transit of said first and second planes by a surface directed towards an opposed electrode of the old electrode or the new electrode.

7. An arrangement according to claim 6, wherein the second detection means is fastened to parts of the withdrawal/introduction device, which are uninfluenced in their position by the different loads of the old electrode and of the new electrode.

8. An arrangement according to claim 6, including storage means connected with the first detection means in order to store the detected electrode displacement travel, and comparison means connected on the one hand with the storage means and on the other hand with the first detection means for comparison of the displacement travel passed through at a moment by an electrode with the stored displacement travel.

9. An arrangement according to claim 8, including further storage means for correction values, which are connected with a superposition unit on the input side to the comparison means, in order to compare in the latter a corrected value of the stored or momentary displacement travel.

10. An arrangement according to claim 8, including loading indicator means for the detection of the loading of holding devices for the electrodes which indicator means are connected with control inputs of switching means between the storage means and the first detector means.

11. An arrangement according to claim 8, wherein the second detection means is connected with control inputs of switch means, which are inserted between the first detection means on the one hand and the storage means on the other hand, and between the first detection means on the one hand and the comparison means on the other hand, and which, controlled by the second detection means, connect the first detection means either with the comparison means or with the storage means.

12. An arrangement according to claim 8, including input switch means connected to said first detection means and said storage means.

13. A method according to claim 1 wherein said first plane and said second plane is the same plane.

14. A detector for detecting the attainment of a predetermined position by electrodes for electrolysis during their exchanging, comprising a lever, which can pivot about an axis and which at least in working position extends into a zone passed through during the removal of an old electrode or introduction of a new electrode, and detector means adapted to detect the movement of the lever.

15. A detector according to claim 14, wherein the lever is held by spring means in at least a working position and there is a controlled driving member adapted to swing the lever out of a rest position into the working position.

16. A detector according to claim 15, wherein the lever is constituted as a two-armed lever, of which one arm is formed for contacting the electrode and of which the second arm is in operative connection with the detector means.

17. A detector according to claim 15, wherein the spring means is constituted as pre-stressed spring means which automatically swing the lever into the rest position after swinging through a predetermined angle from the working position.

18. A detector according to claim 17, including a first elbow lever arranged on the lever, on which acts the spring means, and wherein the line of action of the spring force relative to the axis is displaced laterally in the working position of the lever, and upon attainment of the predetermined angle by the lever the side changes with reference to this axis, so as to when swing the lever into rest position.

19. A detector according to claim 18, including a second elbow lever arranged on the lever, on which acts the driving member in order to swing the lever back from the rest position into the working position.

20. A detector according to claim 15 wherein said spring means is constituted as a spring piston and the drive member is constituted as a hydraulic cylinder.

21. A detector according to claim 14 wherein said detector means includes a light beam.

22. A detector according to claim 21 wherein said detector means further comprises a receiver/transmitter arrangement for sensing said light beam.

23. A detector according to claim 22 wherein said detector means still further comprises a mask movable relative to said receiver/transmitter arrangement for interrupting the sensing of said light beam.

24. A detector according to claim 23 wherein said mask is mounted on said lever.

* * * * *

UNITED STATES PATENT AND TRADEMARK OFFICE

CERTIFICATE OF CORRECTION

PATENT NO. : 4,221,641

DATED : September 9, 1980

INVENTOR(S) : Rudolf Weber and Hans Schaper

It is certified that error appears in the above-identified patent and that said Letters Patent are hereby corrected as shown below:

Column 1, line 35, change "hey" to read --they--.

Column 1, lines 55-56, change "connected" to --corrected--.

Column 2, line 40, change "is" to read --are--.

Column 3, line 52, after "up" insert --of--.

Column 3, line 68, change "is" to read --it--.

Column 4, line 13, change "is" to read --a--.

Column 5, line 36, change "until" to read --after--.

Column 8, line 66, change "of", second occurrence, to --or--.

Column 9, line 5, change "againt" to read --against--.

Column 9, line 37, change "by", first occurrence, to --be--.

UNITED STATES PATENT AND TRADEMARK OFFICE

CERTIFICATE OF CORRECTION

PATENT NO. : 4,221,641

DATED : September 9, 1980

INVENTOR(S) : Rudolf Weber and Hans Schaper

It is certified that error appears in the above-identified patent and that said Letters Patent are hereby corrected as shown below:

Column 10, line 51, after "operation." insert --The invention rather is intended to encompass all such modifications which are within its spirit and scope as defined by the claims.--.

Column 10, claim 1, line 66, after "planes" insert --,--.

Column 11, claim 5, line 28, after "4" insert --,--.

Column 11, claim 5, line 30, change "loading", second occurrence, to --holding--.

Column 12, claim 18, line 47, change "when" to read --then--.

Signed and Sealed this

*Twenty-seventh* Day of *January 1981*

[SEAL]

*Attest:*

RENE D. TEGTMEYER

*Attesting Officer*

*Acting Commissioner of Patents and Trademarks*